US010551769B2

(12) United States Patent
Frisch et al.

(10) Patent No.: US 10,551,769 B2
(45) Date of Patent: Feb. 4, 2020

(54) COLOR PRINTER WITH A CONTROLLER AND A PRINTING STATION FOR EACH COLOR

(71) Applicant: ROTH + WEBER GmbH, Niederdreisbach (DE)

(72) Inventors: Stephan Frisch, Weitefeld (DE); Frank Burda, Siegen (DE)

(73) Assignee: ROTH + WEBER GmbH, Niederdreisbach (DE)

( * ) Notice: Subject to any disclaimer, the term of this patent is extended or adjusted under 35 U.S.C. 154(b) by 0 days.

(21) Appl. No.: 16/325,785

(22) PCT Filed: Aug. 25, 2017

(86) PCT No.: PCT/EP2017/071405
§ 371 (c)(1),
(2) Date: Feb. 15, 2019

(87) PCT Pub. No.: WO2018/037104
PCT Pub. Date: Mar. 1, 2018

(65) Prior Publication Data

US 2019/0227464 A1 Jul. 25, 2019

(30) Foreign Application Priority Data

Aug. 25, 2016 (DE) ..... 10 2016 216 017

(51) Int. Cl.
*G03G 15/16* (2006.01)
*G03G 15/00* (2006.01)

(52) U.S. Cl.
CPC ..... *G03G 15/1615* (2013.01); *G03G 15/5054* (2013.01); *G03G 2215/00156* (2013.01); *G03G 2215/0106* (2013.01)

(58) Field of Classification Search
CPC ..... G03G 15/1615; G03G 15/5054; G03G 15/0189; G03G 2215/0016; G03G 2215/00156
See application file for complete search history.

(56) References Cited

U.S. PATENT DOCUMENTS 4,903,067 A 2/1990 Murayama et al.
5,394,223 A 2/1995 Hart et al.
(Continued)

FOREIGN PATENT DOCUMENTS

DE 69619766 10/2002
DE 102012104584 A1 12/2013
(Continued)

*Primary Examiner* — Walter L Lindsay, Jr.
*Assistant Examiner* — Arlene Heredia
(74) *Attorney, Agent, or Firm* — Smartpat PLC

(57) ABSTRACT

A color printing unit includes one printing station for each color along with one anode roller. A continuous transfer belt is guided over a deflection roller and a control roller. One or more sensors measure a property of reference markings printed on the transfer belt. A control device for controlling and adjusting the transfer belt acts on the control roller through an actuating motor as a function of the detected properties of the reference markings. The one or more sensors are arranged in the area of the control roller for the transfer belt, by which an additional tension roller saves costs and space. During the measurement, at least for the period in which the printed reference markings pass under the one or more sensors, relative movements between the one or more sensors and the control roller are ruled out.

9 Claims, 2 Drawing Sheets

(56) References Cited

U.S. PATENT DOCUMENTS

| | | | |
|---|---|---|---|
| 5,881,346 | A | 3/1999 | Mori et al. |
| 9,335,671 | B2 | 5/2016 | Kudo |
| 2004/0036757 | A1 | 2/2004 | Yoshida |
| 2009/0034992 | A1 | 2/2009 | Yamaguchi et al. |
| 2015/0156376 | A1 | 6/2015 | Paul |
| 2015/0205231 | A1 | 7/2015 | Kishi |

FOREIGN PATENT DOCUMENTS

| | | | |
|---|---|---|---|
| DE | 102016208479 | A1 | 11/2017 |
| EP | 2028557 | A2 | 2/2009 |
| JP | 3399492 | B2 | 4/2003 |

COLOR PRINTER WITH A CONTROLLER AND A PRINTING STATION FOR EACH COLOR

TECHNICAL FIELD

The invention relates to a color printing unit with one printing station for each color along with one anode roller per printing station, with a continuous transfer belt covering the anode rollers and guided over a deflection roller and a control roller, with one or more sensors for detecting in particular the density and/or position of reference markings printed on the transfer belt and with a control device for controlling and adjusting the straight travel of the transfer belt along with the position of the control roller by means of an actuating motor as a function of the detected properties of the reference markings.

BACKGROUND

Such color printing units are the general state of the art for electrophotographic printers. LED or laser full-color printers are also generally known for large-format printing with a print width >297 mm. These have at least four electrophotographic printing units—one for each color—in the respective printing width. For full-color prints, the colors cyan, magenta, yellow and black are superimposed. The literature, for example, the book "Handbuch der Printmedien" (*Handbook of Print Media*) by Helmut Kipphan (ed.), Springer-Verlag Berlin Heidelberg 2000, Chapter 5.2.3: "Farbwerk (Entwicklungseinheit) and Toner" (*Inking Unit* (*Development Unit*) *and Toner*), pages 726 to 730, describes a wide range of options for implementation in detail. There is also a large number of large-format color printers on the market using these and similar technologies.

For a more detailed description of the invention, the design type "Tandem architecture with intermediate carrier belt" is now described, as it is described as the state of the art, for example in U.S. Pat. No. 4,903,067 on the basis of its FIG. 9 in particular. With this type of executing the generation of color prints, for each of the four colors, there is one printing unit from the electrophotographic units described above for a monochrome printer, with the exception of the fixation. Thus, a toner image in the respective colors cyan, magenta, yellow and black is developed on each photo conductor. However, the toner is not transferred directly to the substrate, but is transferred only to an intermediate carrier. Such intermediate carrier is usually designed as a special continuous belt. The belt is referred to as the ITB (intermediate transfer belt) or transfer belt. The four colors are then collected and transferred altogether to the substrate in a single step. Both the transfer from the photo conductors to the transfer belt and the transfer from the transfer belt to the substrate is carried out electrostatically, in a manner analogous to the transfer described above for a monochrome process, from the photo conductor to the substrate. Finally, the toner is fixed to the substrate.

The problem with such color prints, especially with large-format printers, is that the transfer belt can run out of the center even after a relatively short period of operation. Such drift of the transfer belt from its straight run can be caused by changing the transfer belt, the misalignment of the printer, fluctuations in temperature and humidity that bring about an expansion of the transfer belt, the swiveling in and out of the various anode rollers, tolerances in the deflection rollers along with pressure on the cleaning unit.

In order to achieve a constant position of the information on the substrate and to avoid image distortion, it must be ensured that the transfer belt ideally runs straight. If the transfer belt "runs away" or drifts to one side, this can lead to the destruction of the transfer belt. Therefore, it is necessary to use a control for the straight run of the transfer belt, especially in view of the fact that from the first to the last printing station, only a maximum pixel offset of 0.1 mm is permissible.

DE 10 2012 104 584 A1 describes a method for controlling a color printer or a color copier with which a color separation of a first color and a color separation of a second color are printed on the substrate to generate a printed image. Furthermore, at least one control panel with a predetermined pattern of the first and second colors is printed. The total color value of the control field is measured with the assistance of a color value sensor. Furthermore, a deviation between the measured color value and a target color value of the control field is determined and, depending on the deviation, a control signal is generated to correct the register error between the two color separations. With such color prints, the substrate is tensioned by means of transport elements.

U.S. Pat. No. 9,335,671 B2 describes a transfer belt unit having a steering mechanism with an automatic alignment method for the transfer belt, comprising a boundary section configured such that a steering roller for correcting the deviation of the position of the transfer belt is rotatable in width around a steering axis line, while the inclination of the steering roller is limited due to rotation.

An image processing device having color difference detection pattern output device is known from DE 69 619 766 T2; this outputs an image signal for generating a color difference detection pattern for detecting periodic rotational variations occurring in the image processing device. The image processing device further comprises a pattern recognition device for detecting the color difference detection pattern on a continuous carrier. Phase detection means recognize the rotational phase of at least one of the image carriers of the image processing device from a detection signal of the pattern recognition device. Finally, the image processing device is provided with rotational phase controller for individually controlling the rotational phase of at least one of the image carriers of the image processing device and the continuous carrier on the basis of the phase information detected by the phase detecting device.

JP 3399492 B2 describes a belt drive control device that features excellent responsiveness and superb accuracy in position correction and suppresses high frequency vibrations in the normal state after rocking motions. In doing so, a position and speed calculation unit determines at least two of the rocking motion variables. The rocking motion changes the variable and the rocking motion speed in response to the detection signal from the position of the transfer belt. A control unit changes the scanning period of the transfer belt or the control amplification based on a result of the calculation by the position and speed calculation unit. A driver circuit generates a control voltage corresponding to the control output signal of the control unit, in order to drive a steering motor.

A device for tracking the position of a moving photoconductive belt and adjusting an imager in an electrophotographic printing machine, in order to correct alignment errors during the formation of a composite image, is known from U.S. Pat. No. 5,394,223. Registration errors are captured by developing a suitable set of target markers, capturing such target markers, and controlling the imager's position. The photoconductive belt is driven, guided and tensioned by a stripping roller, a tension roller, an idle roller and a drive roller.

Thus, that at least one optical sensor is to be arranged on the transfer belt, with the assistance of which, for example, the density and/or position of reference marks printed on the transfer belt can be measured, is known from such citations. With such measured values, various parameters can be determined; these include stitching, register, i.e. the positional accuracy of the partial color prints (color separations) on the printed product in relation to each other (also called "color register"), and the alignment of the stations. The sensor can be fixed in the area of a specially designed, stationary deflection roller, in the area of which the transfer belt is conveyed without any ripples. For accurate measured values, the sensor is positioned opposite a special tension roller in accordance with the state of the art. The tension roller smoothes the transfer belt at this point, such that errors in recording the optical density (for example, due to ripples of the transfer belt) are avoided. However, such a special deflection roller or such a special tension roller represents an additional expense that has a significant impact both in terms of costs and space requirements.

EP 2 028 557 A2 discloses a sensor device that is arranged in the area of the photo conductor drums and that serves to adjust the speed of the transfer belt. An adjusting of the straight travel of the transfer belt with the aid of the measurement results of the sensor device is not activated.

US 2015/205231 discloses a control roller that serves to control or adjust the straight travel of a transfer belt. However, the sensor means used here are edge sensors for determining the positions of the edge of the transfer belt. Such sensors are arranged in an area where the transfer belt is freely tensioned without guidance.

SUMMARY

The invention is based on the task of forming a color printing unit of the type mentioned above in such a manner that reference marks applied to the transfer belt can be reliably evaluated in a simple manner, such that the transfer belt can always be held in the center by means of a closed loop control.

The task is solved according to the invention for a color printing unit of the type mentioned above with the features as claimed. Advantageous forms are indicated in the dependent patent claims.

The task is solved according to the invention by the fact that the one or more sensors are arranged in the area of the control roller for the transfer belt and that, during the measurement, at least for the period in which the printed reference markings pass under the one or more sensors, relative movements between the one or more sensors and control roller are ruled out. Near the control roller, the transfer belt is also tensioned smoothly, such that the otherwise used deflection and/or tension roller is spared, by which the color printing unit can be produced more cost-effectively and, in particular, is built to be more compact due to the rollers that are spared. Since no relative movements are performed between the one or more sensors and the control roller, while the printed reference markings pass under the one or more sensors, there are no errors in the detection of the reference markings.

It has been shown to be advantageous if the control device is designed in such a manner that any deflection of the control roller is avoided during the period in which the printed reference marks pass under the one or more sensors. This can be implemented without difficulty, since the belt control can easily cope with short interruptions, such as 100 mm reference marks in the feed direction.

It has proved successful if the one or more sensors are mounted on a bar that follows the movements of the control roller. In principle, relative movements are thereby ruled out.

It is worth replicating that the bar is attached to the carriers or bearings of the control roller.

In an advantageous means, the one or more sensors can be formed by a contact image sensor.

It is advantageous if the control roller connected to the control device is deflected in the X and Y direction by the actuating motor, in such a manner that the transfer belt always runs in the center.

It has proven to be advantageous if the one or more sensors are arranged above the control roller and the transfer belt.

It is advantageous if the control roller is designed as a tension roller at the same time. As known, the tensioning effect can be applied evenly at both ends of the control roller by means of spring force or, for example, by adjusting cylinders, but the motors of the control roller can also initially be controlled in such a manner that the same tensioning effect occurs on both sides of the transfer belt and that the control signals for the control roller are superimposed on the tensioning signals. Thus, the control roller would serve as a deflection roller and as a tension roller and a control roller.

BRIEF DESCRIPTION OF THE DRAWINGS

The invention is explained in more detail below using the examples shown in the drawing.

DETAILED DESCRIPTION

Figure 1:
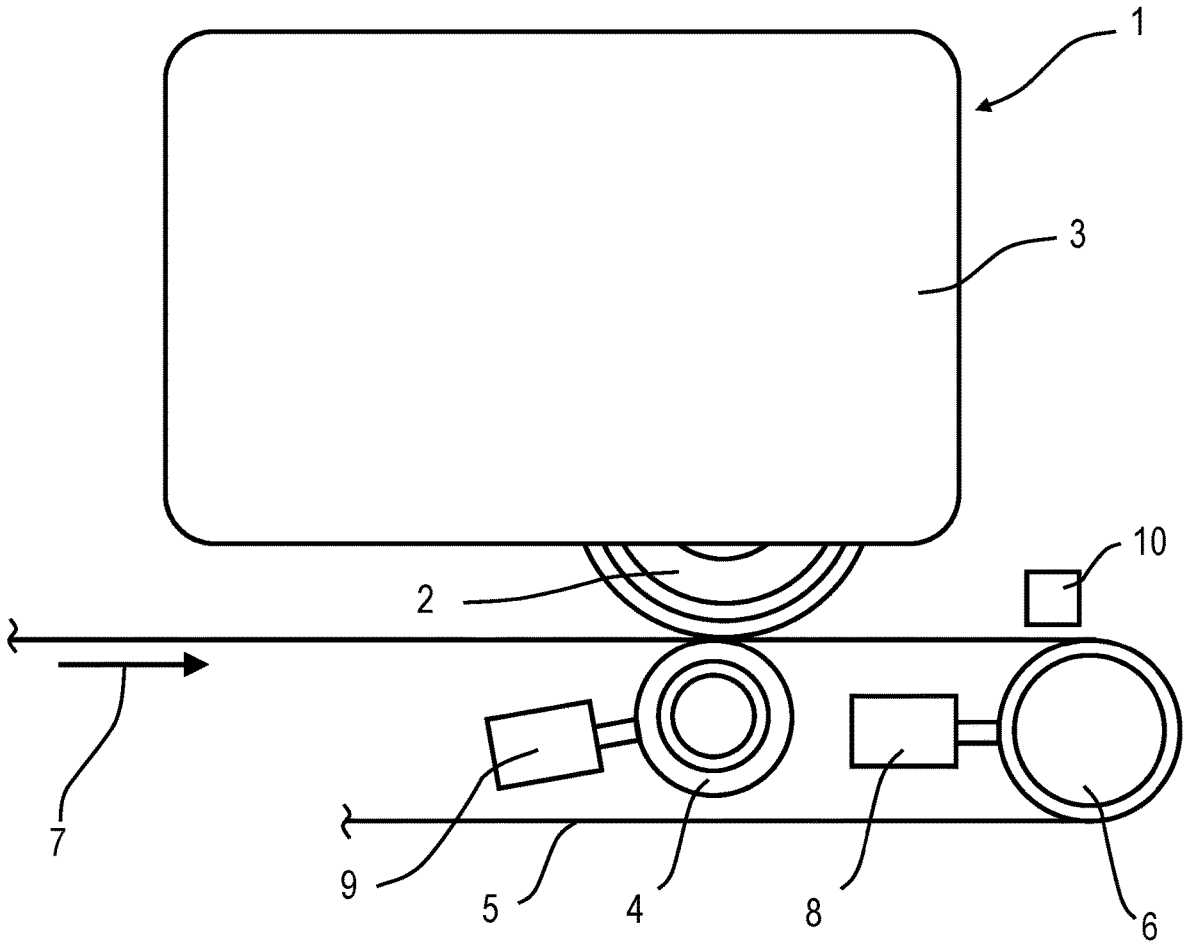
FIG. 1 shows a printing station with a photo conductor drum, an associated anode roller and a control roller for a transfer belt.

FIG. 1 shows a schematic, highly simplified representation of a compact printing station 1 of a color printing unit with a photo conductor drum 2 (OPC—organic photo conductor drum). Around this photo conductor drum 2, a charging unit, a developer unit, an exposure unit and an discharge and cleaning device are arranged in a housing 3, as described in detail in German patent application DE 10 2016 208 479.8.

Between the photo conductor drum 2 and a transfer or anode roller 4, a continuous transfer belt 5 (ITB—intermediate transfer belt) is fed to a control roller 6 for the transfer belt 5. The transfer belt 5 shown in broken form in the diagram is moved in running direction 7 according to the arrow. The control roller 6 is deflected in the X and Y direction with a suitable closed loop control by means of an actuating motor 8, so that the transfer belt 5 always runs in the center and is tensioned when necessary.

By means of an actuating motor 9 for the anode roller 4, it can be brought into its resting position in order to minimize wear, if it is not required in the current printing process.

The surface of the photo conductor drum 2 is electrostatically negatively charged by the charging unit. The charge on the photo conductor drum 2 is now erased by exposure according to the information of the image or picture to be printed by means of the exposure unit at the points at which the toner is to be applied to the photo conductor drum 2 by making the photo conductor drum 2 conductive at the exposed points and accordingly losing its charge. From the developer unit, the negatively charged toner is transferred from a mixing unit via a toner transfer roller to the more positively charged points of the photo conductor drum 2 that have been neutralized by exposure.

The points of the photo conductor drum 2 exposed with the toner are turned further up to the anode roller 4 and the transfer belt 5, where the negatively charged toner of the photo conductor drum 2 is attracted by the anode roller 4 and adheres to the transfer belt 5 located in between. The transfer belt 5 then transports the toner image in the known manner to the medium to be printed in a transfer station.

As the photo conductor drum 2 continues to rotate, the discharge device is used to even out the charge on the photo conductor drum 2 and the cleaning device then removes any residual toner from the photo conductor drum 2.

According to the invention, one or more sensors (10) are arranged above the control roller 6 and the transfer belt 5, which scan the transfer belt 5. The one or more sensors can be, for example, one optical sensor, three optical sensors assigned to the three areas 11 to 13, or one contact image sensor (CIS). Such one or more sensors (10), in particular the contact image sensor, are used to measure the density and/or position of reference marks printed on the transfer belt 5. The detected measured values can be used to determine various parameters such as stitching, register, i.e. the positional accuracy of the partial color prints on the printed product in relation to each other and the alignment of the stations.

Figure 2:
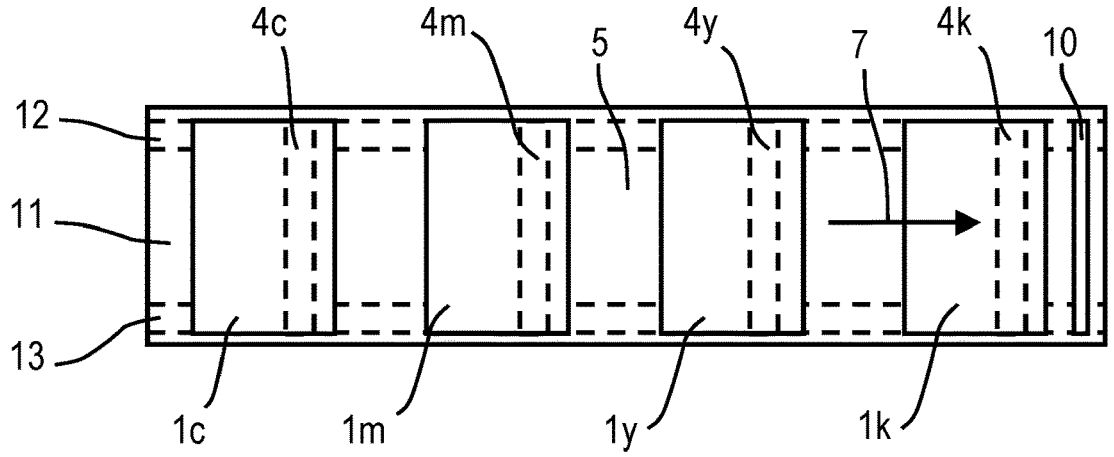
FIG. 2 shows the arrangement of multiple printing stations along the transfer belt.

For each of its colors, for example according to the CMYK color model, a color printer or color copier includes such a printing station 1*c* to 1*k* as described on the basis of FIG. 1, which are arranged one behind the other along the upper branch of the transfer belt 5 as shown in FIG. 2. Below the upper branch of the transfer belt 5, the corresponding anode rollers 4*c* to 4*k* are hidden. Such printing stations 1*c* to 1*k* print only the middle area of the transfer belt 5 with useful information, the useful or print area 11, which is transferred to the print medium. Typically, the left side area 12 and the right side area 13 of the transfer belt 5 remain free on the side.

The arrow again points in the running direction 7 of the transfer belt 5, such that it can be seen that the print area 11 arrives at the printing stations 1*c* to 1*k* one after each other. Thereby, the printing stations 1*c* to 1*k* can print their respective color image on top of each other on the print area 11, creating a latent color toner image on the transfer belt 5 that can be transferred to a color print image on the media to be printed. Such printing stations 1*c* to 1*k* must be matched to each other with regard to an optimum print image, for example with regard to the printing that is perfect in register of the individual printing stations 1*c* to 1*k*, line thickness, area coverage, colors and print image of the individual units. This is done by calibrating the individual components such as printing stations 1*c* to 1*k* and transfer belt 5 using a machine controller described in FIG. 3 below, which synchronizes the components with each other. Thereby, such automatic adjustment and calibration takes place on the transfer belt 5 and not on a printing medium.

Figure 3:
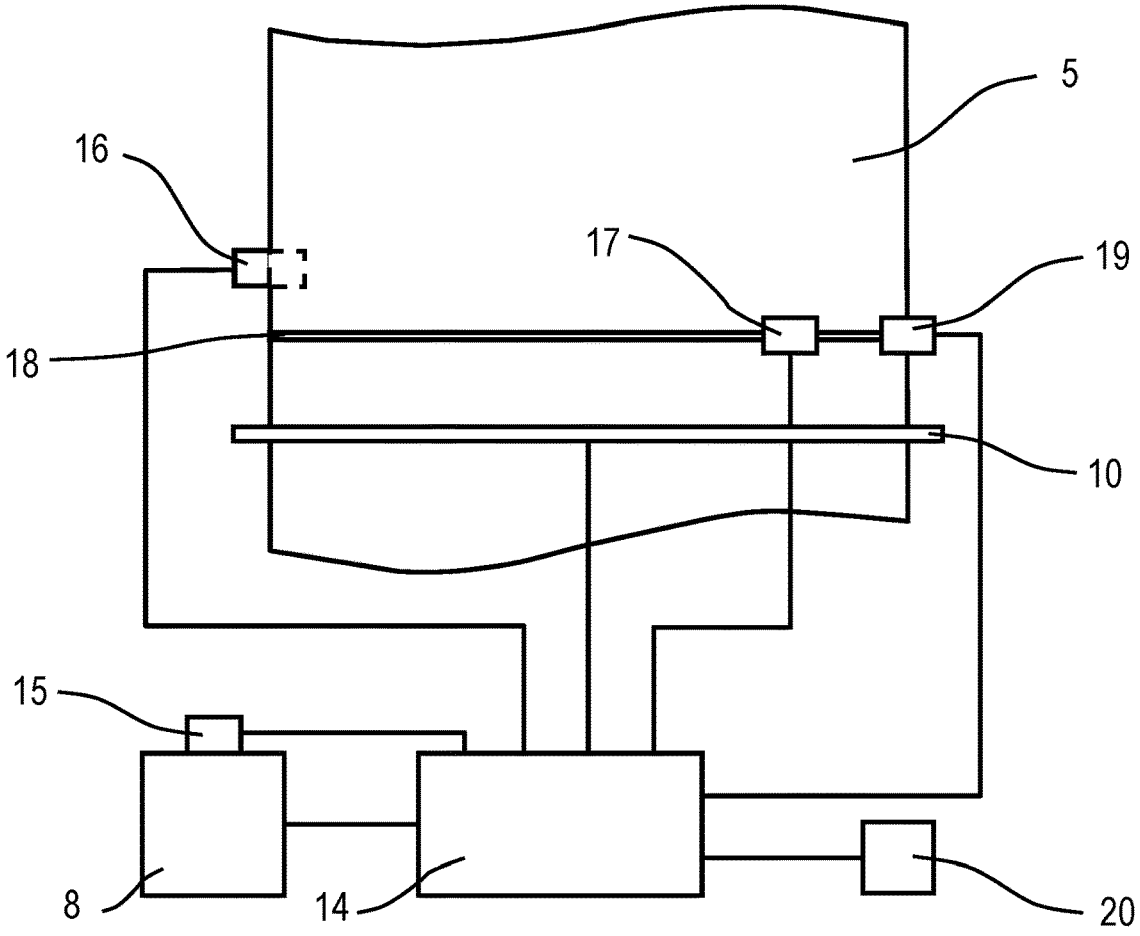
FIG. 3 shows an embodiment according to the invention of the machine controller of the color printing unit.

FIG. 3 shows a machine controller for a color printing unit according to the invention, with which a control device 14 is provided to ensure that the transfer belt 5 does not run out of the center after a relatively short period of operation. The sensor system assigned to control device 14 essentially consists of two forked light barriers, three reflection light barriers, and a gravitational sensor.

The actuating motor 8 responsible for adjusting the control roller 6 in the X and Y direction is connected to the control device 14, so that the transfer belt 5 runs straight and in the center. By adjusting the control roller 6 in the X and Y direction, the actuating motor 8 has a direct influence on the drift of the transfer belt 5.

An initial sensor 15 can be assigned to this actuating motor 8. During its initialization phase, the actuating motor 8 moves with its switch flag up to the switching point of the initial sensor 15, since the motor position is not present as an absolute value. From this point on, the position is calculated and stored repeatedly depending on the travel distance. The initial sensor 15 is a forked light barrier, the light beam of which is interrupted by the switch flag.

If the transfer belt 5 drifts too much in one direction for any reason, an emergency stop should immediately bring the transfer belt 5 to a standstill. For this purpose, two reflex light barriers 16 are mounted under one side of the transfer belt 5. Normally, the transfer belt 5 runs between these two reflex light barriers 16. However, if transfer belt 5 runs out of such area, this is detected and causes transfer belt 5 to be switched off immediately. This mechanism can also be used to detect whether the transfer belt 5 is correctly inserted after a change.

A control sensor 17 detects a white index strip 18 affixed on the transfer belt 5 and thereby calls up the function with the control algorithm in the control device 14. The reflex light barrier used as control sensor 17 is directed from above to the inner side of the transfer belt 5. However, the control sensor 17 is mounted at an angle to the transfer belt 5, so that only the index strip 18 reflects enough light and the control sensor 17 does not always switch by detecting the transfer belt 5.

A belt sensor 19 detects the position of the transfer belt 5. The forked light barrier used for this purpose supplies an analog signal that is evaluated by the control device 14 for controlling the actuating motor 8. For the actual adjustment of transfer belt 5, a programmed digital PI controller is provided in control device 14. The adjustment function in the program is always called up once per cycle. The call up occurs if the control sensor 17 detects the index strip 18. This ensures that this always takes place at the same intervals, but also that the belt position is scanned at the same point. In order to determine the current actual value of the strip position, 50 scans are taken at the time of scanning and the mean value is calculated from such values.

In addition to the actual control sensor system, the printer also has a gravitational sensor 20, which detects a possible tilted position of the large-format color printer. If such tilted position exceeds the control range of the transfer belt 5, the user is prompted to align the printer. Thereby, a monitor shows the user which stand has to be adjusted.

The printer also has a temperature and humidity sensor that can be built into the control device 14. The measured values of such sensors are directly taken into account by the control algorithm.

Other influences on the transfer belt 5 are detected and corrected directly by means of the forked light barrier.

The control device 14 causes the printing of at least one predestined or fixed pattern by means of the printing stations 1*c* to 1*k*, preferably on at least one of the side areas 12 and 13 of the transfer belt 5. This pattern, which is then read out by the one or more sensors 10, is compared with predefined pattern images in the control device 14. Based on this evaluation, the individual components are controlled until the predestined pattern on the transfer belt 5 corresponds to the defined pattern image.

The evaluation and adjustment are preferably carried out continuously, in particular by recording and taking into account changes in temperature and/or humidity.

The control device 14 ensures, in particular, the printing that is perfect in register of the individual printing stations relative to each other, such that the lines printed by the printing stations 1*c* to 1*k* on the side areas 12 and 13 of the transfer belt 5 are located on top of each other. The control device 14 also adjusts the line thickness, area coverage, toner application, color calibration, color mixing, color homogeneity, scale setting, speed calibration, and straight run of the transfer belt 5.

For example, the data detected by the contact image sensor 10 and acquired by the control device 14 can be used to influence the light intensity and/or exposure time of the print heads, the toner application of the respective printing station 1*c* to 1*k*, an adjustment of the high voltages for toner transfer via a power supply, the speeds of the drives and an alignment of the transfer belt 5 by means of the actuating motor 8.

Such processes preferably can be carried out online during a print run. However, they can also be carried out at any time outside the printing process. In addition, larger patterns can be applied to the transfer belt 5 in the middle print area 11 between two print applications, where the print medium is otherwise described.

At least one optical sensor 10 is arranged on the transfer belt, with the assistance of which the density and/or position of the reference marks printed on the transfer belt 5 is measured. Instead of an optical sensor, three individual sensors can be arranged in the middle of the transfer belt 5 and on the side areas 11 and 12. However, the contact image sensor can also scan the entire width of the transfer belt 5. In order to obtain accurate measured values, the sensor is arranged opposite a special tension roller in accordance with the state of the art. Such tension roller smoothes the transfer belt 5 at this point, such that errors in detection of the optical density, for example due to the ripples in the transfer belt, are avoided.

With the color printing unit in accordance with the invention, such an additional tension roller is now spared, which results in significant advantages in terms of both costs and space requirements. As the sensor 10 is mounted in the area of the control roller 6 for the transfer belt 5, the expense can be minimized or avoided. The control roller 6 is directly deflected with a suitable adjusting by the control device 14, with the possibility of adjustment in the X and Y direction, such that the transfer belt 5 is always held in the center. However, such frequently occurring deflection of the control roller 6 would cause inaccuracies in the sensor data.

However, the control device 14 is designed in such a manner to control the color printing unit such that the deflection and adjusting of the control roller 6 is prevented for the period in which the printed reference marks pass under the one or more sensors 10. In practical terms, this can be easily implemented, since the belt control can withstand short interruptions, such as 100 mm reference marks in the feed direction, without difficulty.

So that the reference markings can be reliably detected by the one or more sensors, they must either be applied to the transfer belt 5 in a fixed cycle and the control device 14 synchronously interrupts the adjustment of the control roller 6. Or they are detected by a sensor arranged in front of the one or more sensors, which then transmits a signal to the control device 14 to interrupt the adjustment of the control roller 6. Such task can be performed, for example, by the control sensor 17.

In a variant according to the invention, the sensors 10, for example the contact image sensor, are mounted on a bar that follows the movements of the control roller 6. Thus, it is essential that no relative movements occur between the one or more sensors 10 and the control roller 6 during the measurements.

LIST OF REFERENCE SIGNS

1. Printing station
2. Photo conductor drum (OPC—organic photo conductor drum)
3. Housing
4. Transfer or anode roller
5. Transfer belt (ITB—intermediate transfer belt)
6. Control roller
7. Running direction
8. Actuating motor for the control roller
9. Actuating motor for the anode roller
10. One or more sensors
11. Useful or print area
12. Left-hand side
13. Right-hand side
14. Control device
15. Initial sensor
16. Reflex light barriers
17. Control sensor
18. Index strip
19. Belt sensor
20. Gravitational sensor

The invention claimed is:

1. A color printing unit, comprising: one printing station for each color; one anode roller per printing station; a continuous transfer belt covering the anode rollers and guided over a deflection roller and a control roller; one or more sensors for measuring properties of reference markings printed on the transfer belt; and a control device for controlling and adjusting straight travel of the transfer belt by an actuating motor acting on the control roller as a function of the measured properties of the reference markings, wherein the one or more sensors are arranged in an area of the control roller for the transfer belt, wherein the control roller can be deflected in an X and Y direction via the actuating motor, and wherein, during the measurement, at least for a period during which the printed reference markings pass under the one or more sensors, relative movements between the one or more sensors and the control roller are ruled out.

2. The color printing unit according to claim 1, wherein the one or more sensors for measuring properties measure a density and/or a position of the reference markings printed on the transfer belt.

3. The color printing unit according to claim 1, wherein the control device is designed in such a manner that any deflection of the control roller is avoided during the period in which the printed reference marks pass under the one or more sensors.

4. The color printing unit according to claim 1, wherein the one or more sensors are mounted on a bar that follows the movements of the control roller.

5. The color printing unit according to claim 4, wherein the bar is attached to carriers or bearings of the control roller.

6. The color printing unit according to claim 1, wherein the one or more sensors are a contact image sensor.

7. The color printing unit according to claim 1, wherein the control roller connected to the control device is deflected in the X and Y direction by the actuating motor in such a manner that the transfer belt always runs in the center.

8. The color printing unit according to claim 1, wherein the one or more sensors are arranged above the control roller and the transfer belt.

9. The color printing unit according to claim 1, wherein the control roller also functions as a tension roller.

* * * * *